US005506478A

United States Patent [19]

Daetz

[11] Patent Number: 5,506,478

[45] Date of Patent: Apr. 9, 1996

[54] AC IGNITION SYSTEM WITH OPTIMIZED ELECTRONIC CIRCUIT

[75] Inventor: Michael Daetz, Tiddische, Germany

[73] Assignee: Daug Deutsche Automobilgesellschaft mbH, Braunschweig, Germany

[21] Appl. No.: 408,040

[22] Filed: Mar. 21, 1995

[30] Foreign Application Priority Data

Mar. 23, 1994 [DE] Germany ..... 44 09 984.3

[51] Int. Cl.[6] ..... H05B 37/02

[52] U.S. Cl. ..... 315/209 T; 315/209 CD; 315/209 SC; 361/256; 361/257

[58] Field of Search ..... 315/209 T, 209 R, 315/209 CD, 209 SC; 361/253, 256, 257, 263; 123/406

[56] References Cited

U.S. PATENT DOCUMENTS

| | | | |
|---|---|---|---|
| 3,914,665 | 10/1975 | Johnson et al. | 317/156.6 |
| 3,945,362 | 3/1976 | Neuman et al. | 123/148 |
| 4,359,038 | 11/1982 | Xiberas . | |

FOREIGN PATENT DOCUMENTS

| | | |
|---|---|---|
| 0034787 | 9/1981 | European Pat. Off. . |
| 0070572 | 1/1983 | European Pat. Off. . |
| 1539183 | 6/1970 | Germany . |
| 3928726 | 3/1991 | Germany . |
| 4237271 | 5/1994 | Germany . |
| 4409985 | 9/1994 | Germany . |
| 60-209667 | 10/1985 | Japan . |

OTHER PUBLICATIONS

K. Rischmüller: "Vor dem Ausfall schützen". IN: elektrotechnik 59, vol. 11, Jun. 10, 1977, pp. 14–19.

*Primary Examiner*—Robert J. Pascal
*Assistant Examiner*—Reginald A. Ratliff
*Attorney, Agent, or Firm*—Spencer & Frank

[57] ABSTRACT

In an alternating current ignition system whose ignition output stage has an ignition coil, a resonant-circuit capacitor for generating a bipolar alternating current, a semiconductor switch for controlling the primary coil current and an energy recovery diode connected in parallel to the semiconductor switch, the current flowing through the diode serves as control signal for the semiconductor switch and triggers the switching-on of the semiconductor switch.

10 Claims, 3 Drawing Sheets

AC IGNITION SYSTEM WITH OPTIMIZED ELECTRONIC CIRCUIT

BACKGROUND OF THE INVENTION

The invention relates to an alternating current ignition system with at least one ignition output stage, comprising an ignition coil with a primary and a secondary winding, a semiconductor switch connected in series to the primary winding, a resonant-circuit capacitor that provides a resonant circuit for generating a bipolar alternating current with the primary coil, and an energy recovery diode arranged in parallel to the semiconductor switch. An alternating current ignition system of this kind is known from DE-OS 39 28 726 and, compared with conventional ignition systems such as, for instance, the so-called transistor ignition systems with inactive high-voltage distribution, has the advantage that small and consequently low-cost ignition coils can be used. As a result, the time of ignition is reached quickly, within a matter of microseconds. Furthermore, according to the above-mentioned publication, optimum ignition is ensured by it remaining in the switched-on state for the entire period of combustion irrespective of the engine speed and during which it generates a bipolar sparking current.

An alternating current ignition system of the kind known from the above-mentioned publication is shown in FIG. 1. In this Figure, reference character Z designates an ignition output stage that has an ignition coil Tr with a primary and a secondary coil, a semiconductor switch T connected in series to the primary coil, as well as a resonant-circuit capacitor C and an energy-recovery diode D that are also arranged in series to the primary winding. Also in series with the semiconductor switch T, there is a current measuring resistor R1 for detecting the actual value of the primary coil current. A control circuit 1 controls the semiconductor switch T through its control electrode for which purpose the voltage drop across the resistor R1 and the voltage $U_T$ across the semiconductor switch T is supplied via the circuit junction point A. A control signal containing the ignition signal is supplied to the control circuit 1 via its connection $U_{st}$. A switched-mode power supply not shown in FIG. 1 generates an operating voltage $U_B$ of 180 V that is applied to the primary coil of the ignition coil Tr. The switched-mode power supply is in turn supplied from an on-vehicle battery.

The ignition output stage Z is operated in Current Mode, i.e. the semiconductor switch T is switched on until the current flowing through the primary coil reaches a specific value and then the semiconductor switch T switches off so that the energy stored in the primary coil can charge the capacitor C. This leads to an approximately sinusoidal variation of the voltage applied at the semiconductor switch T and at the same time the negative half-wave of the oscillation is limited by diode D to small voltage amplitudes. During this phase of current flow through diode D, the semiconductor switch T should again be switched on. At this moment, the switch-on losses are also very low because the voltage applied to the semiconductor switch T has a value that is very nearly zero.

The actual value of the current flowing through the primary winding is normally measured through the voltage drop across the resistor R1. When the current has reached its command value, the semiconductor switch T is switched off and consequently the voltage across the resistor R1 decays very rapidly. In order to prevent the semiconductor switch T from switching on again immediately, various measures are known.

One of the known measures involves evaluating the voltage $U_T$ on the semiconductor switch T. In accordance with FIG. 1, this is accomplished by the junction point A of the semiconductor switch T together with the winding of the ignition coil Tr being connected to the control circuit 1 where it is evaluated. This solution has the disadvantage, however, that the next switching-on operation can be prevented only when the voltage $U_T$ has reached a value that is greater than the supply voltage $U_B$. Therefore, in order to prevent oscillations from occurring during the time until the voltage $U_T$ has reached the value of the supply voltage $U_B$, an additional disabling means, such as a timing element, must be used. Another disabling device of this kind must also be used if the voltage $U_T$ at the semiconductor switch T again drops below the value of the supply voltage $U_B$ in order to obtain the above-mentioned advantage of switching at a voltage level of almost zero. The disadvantage of such a simple type of timing element, however, is that the switch-off threshold of the primary current is affected. Where there are several primary circuits, a further disadvantage is that the voltages $U_T$ generated at the semiconductor switches T must be measured at least once per primary circuit, even if the evaluation of the primary currents takes place only once for the entire ignition system.

In another known solution, a monostable flip-flop (monoflop) is used in order to prevent the semiconductor switch T from switching on again for a defined period of time. This solution with a defined time delay has the disadvantage that the time delay to be selected is firstly a function of the selected primary current and secondly it also depends on whether the breakdown of the spark gap on the secondary side of the ignition coil has already taken place or not. Finally, the tolerances of all time-determining components are included in the time delay to be selected. Consequently, this solution cannot in all cases guarantee reliable operation of the output stage.

SUMMARY OF THE INVENTION

The object of the invention is to provide an alternating current ignition system of the kind named at the outset, having a simple circuit for controlling the semiconductor switch and with which reliable operation of the ignition system is guaranteed.

According to the invention, the current flowing through the diode is used as control signal for the semiconductor switch. Thus, the onset of current flow through the energy recovery diode acts as trigger signal for switching on the semiconductor switch again. Advantageously, the voltages at the semiconductor switch are low at this time so that no electrical losses occur when switching on. The current is then transferred to the semiconductor switch on passing through zero of the oscillations generated by the capacitor and the primary coil. Preferably, the current flowing through the energy recovery diode is detected by a resistor with a low resistance value connected in series to this diode.

In one embodiment of the alternating current ignition system according to the invention, the resonant-circuit capacitor can be arranged in parallel to the semiconductor switch, as known from DE-OS 39 28 726 mentioned above.

A particularly advantageous embodiment results when the resonant-circuit capacitor is connected in parallel to the primary coil of the ignition coil. The voltage applied to the capacitor is thus reduced by about 20% so that a lower-cost component can be used.

As a rule, an alternating current ignition system has several ignition output stages and each of these has its own energy recovery diode. In such an embodiment of the invention, the diodes are connected by forming a wired-OR circuit in order to be able to take their diode currents to a single resistance whose voltage drop then serves as trigger signal for again switching on the semiconductor switch. Advantageously, this allows evaluation of the diode current to be performed only once for the complete system and not for each individual channel.

Furthermore, in another preferred embodiment of the invention, a clamping circuit is provided for limiting the voltage applied to the semiconductor switch, said voltage being built up from a voltage divider and a comparator connected in series behind it. This voltage divider is connected directly to the circuit junction that joins the semiconductor switch with the primary coil, whereas the output of the comparator controls the control electrode of the semiconductor switch directly. With a clamping circuit of this kind, it is possible to reliably prevent the maximum permissible voltages at the semiconductor switch, at the energy recovery diode and at the resonant-circuit capacitor from being exceeded. Without such a clamping circuit, correspondingly great safety allowances with respect to the maximum permissible values would have to be maintained to compensate for tolerances and this would have a negative effect on costs in terms of components. The clamping circuit causes the voltage $U_T$ at the semiconductor switch to be limited to a value that is only slightly lower than the maximum permissible value. This means that the components used can be operated at a level approaching their working limit.

Furthermore, compared with the usual application of zener diodes, a clamping circuit of this kind offers the advantage that, when providing the circuit in the form of an integrated circuit, little chip area is required because at the voltages in the kV range that occur in the alternating current ignition system very many zener diodes would be required and this would result in the need for a large chip area.

In known ignition systems, bipolar transistors, power MOS field-effect transistors or IGBT transistors (Isolated Gate Bipolar Transistors) are used as semiconductor switches. An advantageous embodiment of the invention is also obtained with an MOS-controlled thyristor (MCT) as semiconductor switch. With such MCT thyristors, the advantageous properties of thyristors such as high dielectric strength, low on-state power losses and high specific current carrying capacity are combined with the property of being able to turn off the previously used power semiconductors.

BRIEF DESCRIPTION OF THE DRAWINGS

The invention will now be described and explained on the basis of embodiment examples in conjunction with the Figures. These show.

DESCRIPTION OF THE PREFERRED EMBODIMENTS

Figure 1:
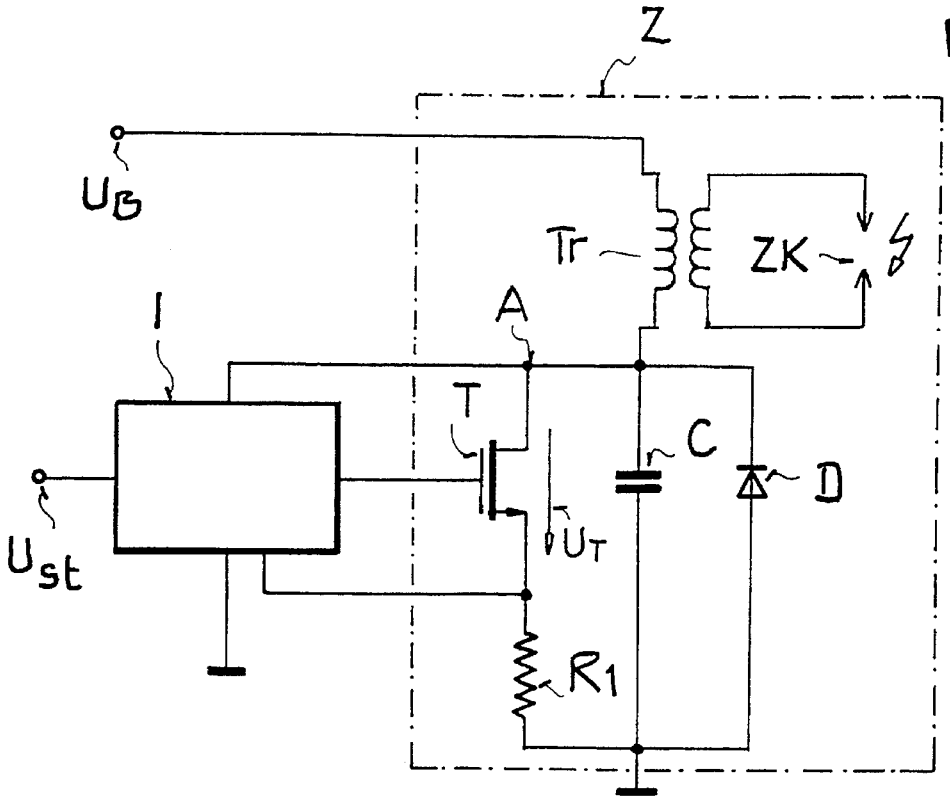
FIG. 1 A circuit diagram according to the prior art, as discussed above.
Figure 2:
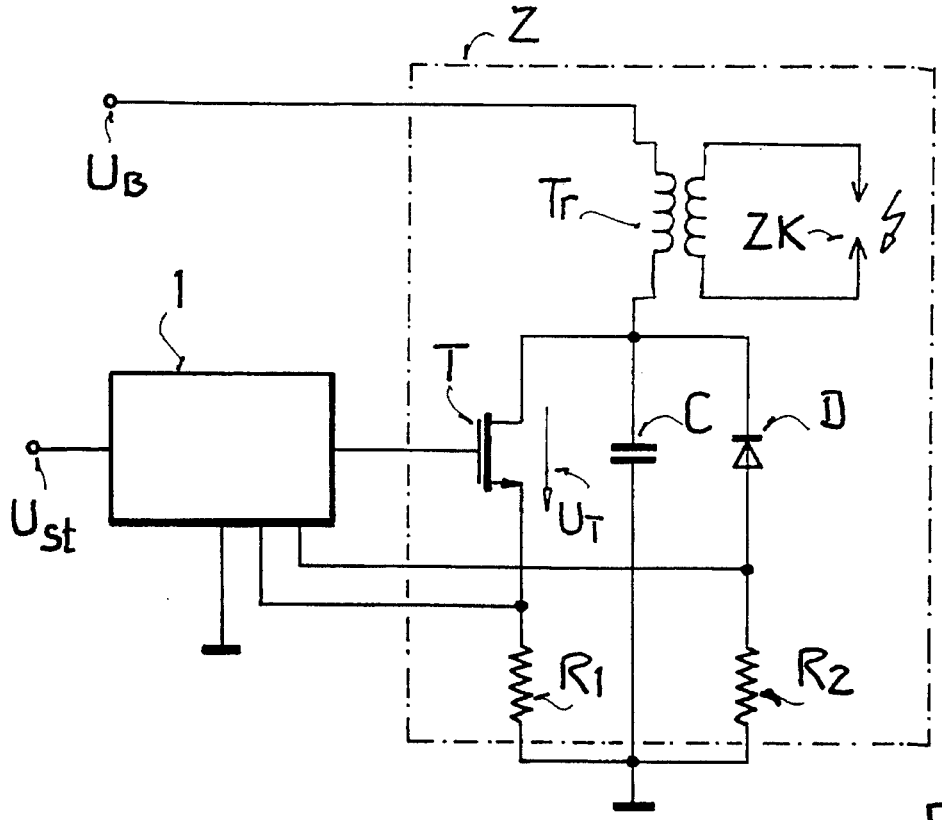
FIG. 2 A circuit diagram of a first embodiment of the alternating current ignition system in accordance with the invention.

In contrast to that of FIG. 1, the circuit diagram of an alternating current ignition system in accordance with FIG. 2 has a resistor R2 connected in series with energy recovery diode D. The current through this diode D begins to flow in the negative half-wave of the voltage oscillation generated by the capacitor C and the primary coil of the ignition coil Tr. The voltage drop that then occurs across this resistor R2 is supplied to the control circuit 1 so that this voltage signal can be used as trigger signal for again switching on the semiconductor switch T. Since only low voltages exist at the semiconductor switch T at this time, switching on can take place without electrical losses. The current is then transferred to the semiconductor switch T on passing through zero of the oscillation. The resistor R2 is dimensioned with a low ohmic value so that the voltage drop across it is sufficient to operate an electronic switch such as a bipolar transistor. Compared with the circuit given in FIG. 1, the conductor between the circuit junction that connects the semiconductor switch T to the primary coil and the control circuit 1 can be omitted.

Figure 3:
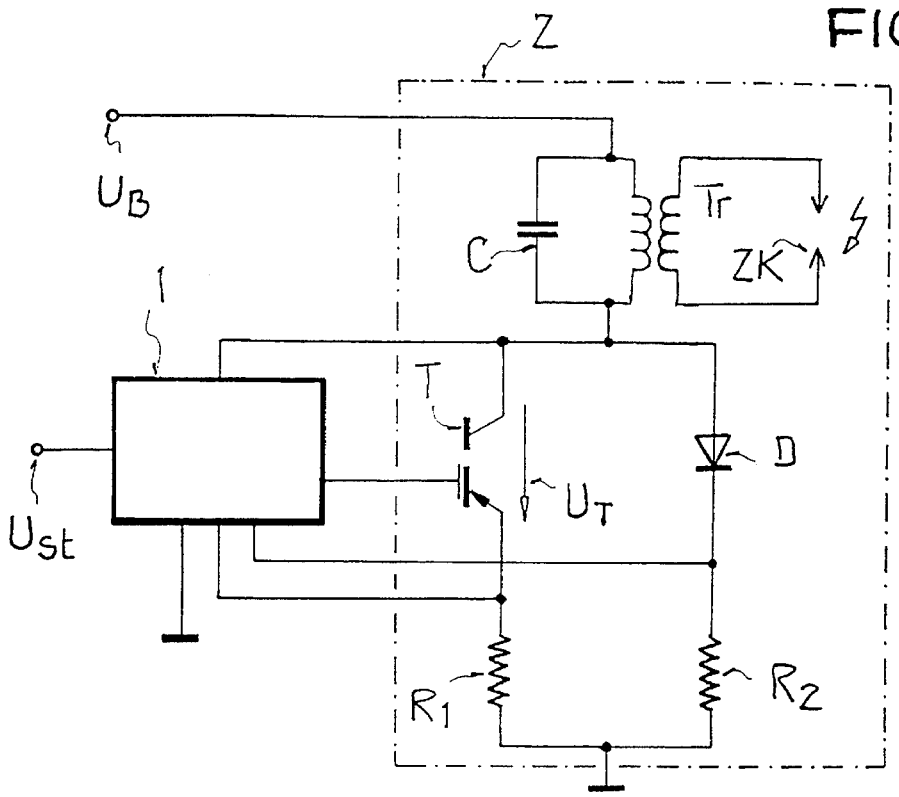
FIG. 3 A circuit diagram of another embodiment of the alternating current ignition system in accordance with the invention with an MCT thyristor as semiconductor switch.

The embodiment example given in FIG. 3 differs from that in FIG. 2 firstly in that the resonant-circuit capacitor C is connected in parallel to the primary coil of the ignition coil Tr and secondly in that an MOS-controlled thyristor (MCT) is used as semiconductor switch T. An MCT thyristor of this kind combines the advantageous properties of thyristors such as high dielectric strength, low on-state power losses and high specific current carrying capacity with the ability to turn off the previously used power semiconductors such as bipolar transistors, power MOS field effect transistors or IGBT transistors.

The advantage obtained by connecting the resonant-circuit capacitor C in parallel to the primary coil is that the voltage applied to this capacitor is reduced by about 20% so that a lower-cost component can be used.

In the circuits shown in FIGS. 2 and 3, the voltage drop across the resistor R1 is, as before, supplied to the control circuit 1 in order to detect the actual value of the primary coil current.

Figure 4:
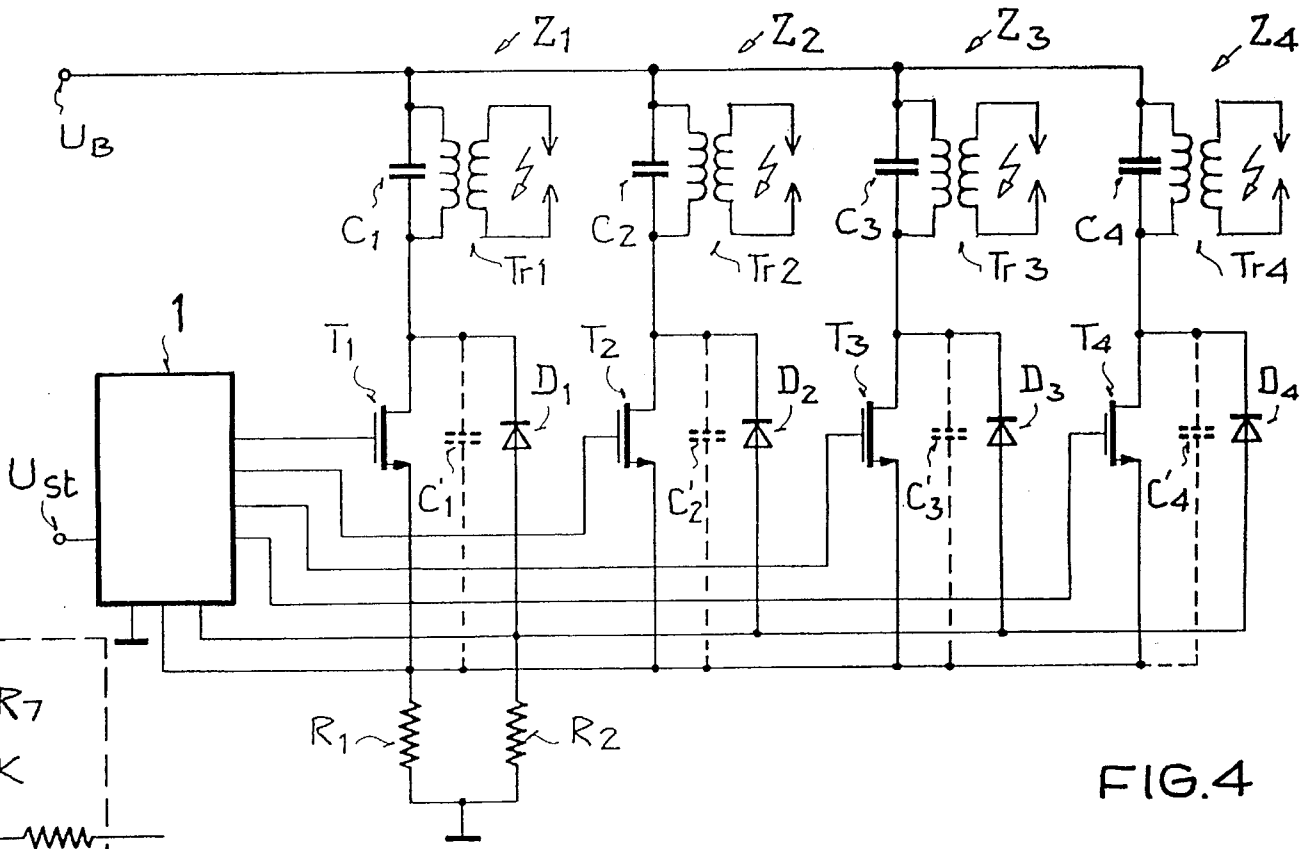
FIG. 4 A circuit diagram of another embodiment of the alternating current ignition system in accordance with the invention with four ignition end stages.

The circuit according to FIG. 4 shows an alternating current ignition system with four ignition output stages Z1 to Z4. Each of these ignition output stages includes an ignition coil Tr1 to Tr4, a resonant-circuit capacitor C1 to C4 connected in parallel to the primary coil, a semiconductor switch T1 to T4 connected in series to the primary coil, and an energy recovery diode D1 to D4 connected in parallel to the semiconductor switch. These diodes D1 to D4 are connected in each case with their cathode to the circuit junction that connects the semiconductor switch to the primary coil, and their anodes are taken to a single resistor R2 which in turn is connected to reference potential. This wired-OR circuit made up from diodes D1 to D4 means that the diode current need be evaluated only once for the entire alternating current ignition system and not for each channel individually.

A corresponding wired-OR circuit is also provided for the source electrodes of the semiconductor switches T1 to T4 by means of a single resistor R1 the voltage drop of which serves to determine the actual value of the primary coil current for all ignition output stages Z1 to Z4.

Instead of being connected in parallel to the primary coils, the resonant-circuit capacitors C1 to C4 can also be connected in parallel to the semiconductor switches T1 to T4 in accordance with the reference characters C1' to C4'.

Figure 5:
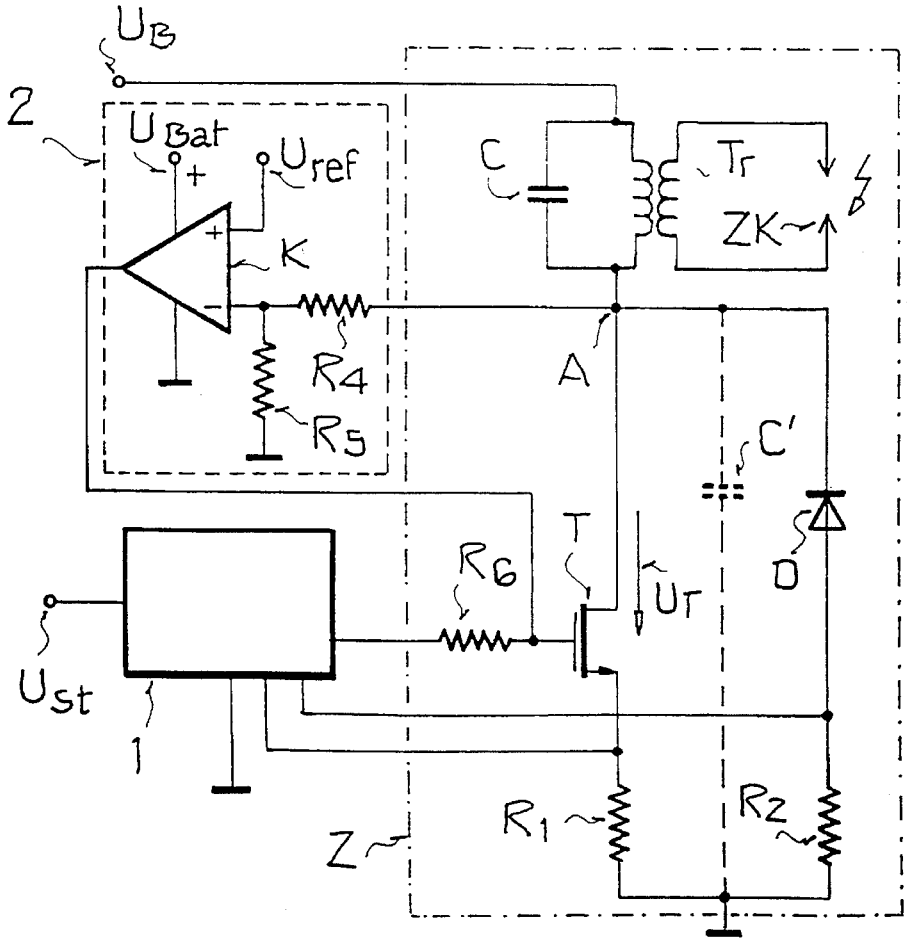
FIG. 5 A circuit diagram of an embodiment of the alternating current ignition system in accordance with the invention with a clamping circuit.

FIG. 5 shows a circuit arrangement for an alternating current ignition system in accordance with FIG. 2 with a resonant-circuit capacitor C' arranged in parallel to the semiconductor switch T. This capacitor can also be connected in parallel to the primary coil in accordance with FIG. 3 (see reference character C). In contrast to the circuits given in FIGS. 2 and 3, this FIG. 5 includes a clamping circuit 2 for limiting the voltage at the semiconductor switch T. This clamping circuit 2 prevents the maximum permissible voltage of the diode D and the resonant-circuit capacitor C or C' respectively from being exceeded at the semiconductor switch T. Without a clamping circuit of this kind, correspondingly high safety allowances with respect to the maximum permissible values would have to be maintained to compensate for tolerances. Considerable tolerances, such as the capacitance tolerances of the resonant-circuit capacitor C or C' respectively, the inductance tolerances of the ignition coil Tr, the tolerances in the current regulation circuit and the tolerances of the load conditions on the secondary side of the ignition coil Tr would have to be taken into account. If all these tolerances were to be considered, very high safety allowances would result and therefore correspondingly high costs. The clamping circuit 2 thus causes, for instance, the voltage $U_T$ generated at the semiconductor switch T to be limited to a value that is only slightly lower than the maximum permissible value. This means that the expensive components, that is the semiconductor switch T, the resonant-circuit capacitor C and C' respectively, and the energy recovery diode D can be utilized almost up to their operational limits.

The clamping circuit 2 shown in FIG. 5 comprises a voltage divider R4/R5 and a comparator K connected behind it in series. The voltage divider R4/R5 is connected to the junction point A, which joins the semiconductor switch T to the primary coil, whereas the output of the comparator K is connected in the first place directly to the control electrode of the semiconductor switch T and in the second place through a resistor R6 to the output of the control circuit 1. An accurate and temperature-stable reference voltage source $U_{ref}$ provides the comparative standard for limiting the voltage $U_T$ generated at the semiconductor switch T by supplying this to the non-inverted input of the comparator K. The tapping point of the voltage divider R4/R5 is connected to the inverting input of the comparator K. The voltage $U_T$ generated at the semiconductor switch T is divided down by this voltage divider R4/R5 and compared with the reference voltage $U_{ref}$ by the comparator circuit K. The output of the comparator K triggers the semiconductor switch T which results in high accuracy and long-term constancy of the clamp voltage.

Figure 6:
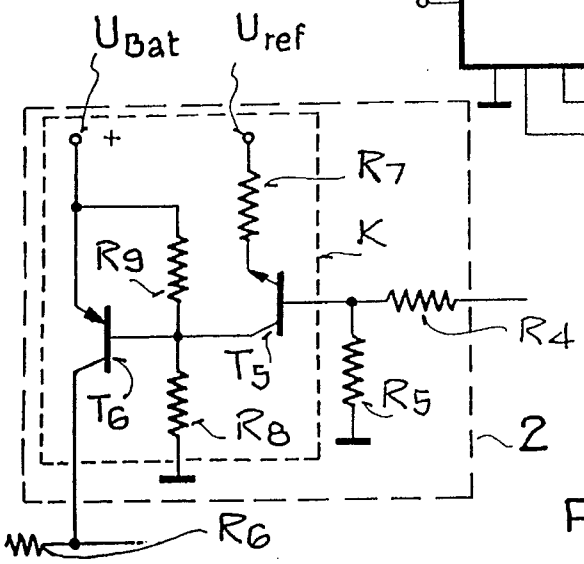
FIG. 6 A detailed circuit diagram of a clamping circuit in accordance with FIG. 5.

FIG. 6 shows a circuit configuration of the clamping circuit according to FIG. 5, the comparator K being made up of an npn transistor T5 and a pnp transistor T6. The base electrode of transistor T5 is connected with the voltage divider R4/R5, while its emitter electrode is applied through a resistor R7 to the reference voltage source Uref and its collector electrode is taken to the base electrode of transistor T6. Furthermore, the base electrode of transistor T6 is connected firstly through a resistor R8 to the reference potential and secondly through a resistor R9 to the emitter electrode of transistor T6. Also, said emitter electrode of transistor T6 is connected to the battery voltage $U_{Bat}$. The collector electrode of transistor T6 provides the output of the comparator. When the base voltage of transistor T5 rises to a value that is greater than the sum of its base-emitter voltage and the reference voltage $U_{ref}$, this transistor T5 becomes conductive. This allows the collector current of transistor T5 to trigger transistor T6 which amplifies this current and thus triggers semiconductor switch T. The resistor circuitry with resistors R7 to R9 is designed in such a way that a rapid response is obtained without harmonics and subharmonics.

If this clamping circuit 2 according to FIG. 6 is made as an integrated circuit, it offers the advantage of requiring a small chip area compared with the conventional use of zener diodes because, in the latter case, very many zener diodes would be needed on account of the high voltages in the kV range that arise in the alternating current ignition system. A solution with integrated circuits using these zener diodes would call for a large chip area.

In the alternating current ignition systems according to FIGS. 4 and 5, an MCT thyristor can also be used for the semiconductor switch T.

Furthermore, in an ignition system according to FIG. 4, a clamping circuit 2 according to FIG. 5 or FIG. 6 can be used in each case for all ignition output stages Z1 to Z4.

What is claimed is:

1. Alternating current ignition system with at least one ignition output stage (Z, Z1 . . . Z4) comprising an ignition coil (Tr, Tr1 . . . Tr4) with primary and secondary winding, a semiconductor switch (T, T1 . . . T4) connected in series to the primary winding, a resonant-circuit capacitor (C, C1 . . . C4), forming a resonant circuit for generating a bipolar alternating current with the primary coil, and an energy recovery diode (D, D1 . . . D4) arranged in parallel to the semiconductor switch (T, T1 . . . T4), wherein the current flowing through the energy recovery diode (D, D1 . . . D4) is used as control signal for the semiconductor switch (T, T1 . . . T4).

2. Alternating current ignition system in accordance with claim 1, wherein the current flowing is detected by a resistor (R2) connected in series with the energy recovery diode (D, D1 . . . D4).

3. Alternating current ignition system in accordance with claim 2, wherein the resonant-circuit capacitor (C, C1 . . . C4) is connected in parallel to the semiconductor switch (T, T1 . . . T4).

4. Alternating current ignition system with at least two ignition output stages (Z1 . . . Z4) in accordance with claim 3, wherein the diodes (D1 . . . D4) are joined together and the evaluation of the current flowing through the diodes is effected by means of a single resistor (R2) connected to the junction point of the diodes.

5. Alternating current ignition system in accordance with claim 4, wherein a clamping circuit (2) is provided to limit the voltage ($U_T$) generated at the semiconductor switch (T, T1 . . . T4), wherein this clamping circuit (2) comprises a voltage divider (R4/R5) and a comparator (K) connected in series behind it, and wherein the voltage divider (R4/R5) is connected to the branch of the circuit that joins the semiconductor switch (T, T1 . . . T4) and the primary coil and the output of the comparator (K) is taken to the control electrode of the semiconductor switch (T, T1 . . . T4).

6. Alternating current ignition system in accordance with claim 5, wherein a MOS-controlled thyristor (MCT) is used as semiconductor switch (T, T1 . . . T4).

7. Alternating current ignition system in accordance with claim 2, wherein the resonant-circuit capacitor (C, C1 . . . C4) is connected in parallel to the primary coil of the ignition coil (T, T1 . . . T4).

8. Alternating current ignition system with at least two ignition output stages (Z1 . . . Z4) in accordance with claim 7, wherein the diodes (D1 . . . D4) are joined together and the evaluation of the current flowing through the diodes is effected by means of a single resistor (R2) connected to the junction point of the diodes.

9. Alternating current ignition system in accordance with claim 8, wherein a clamping circuit (2) is provided to limit the voltage ($U_T$) generated at the semiconductor switch (T, T1 . . . T4), wherein this clamping circuit (2) comprises a voltage divider (R4/R5) and a comparator (K) connected in series behind it, and wherein the voltage divider (R4/R5) is connected to the branch of the circuit that joins the semiconductor switch (T, T1 . . . T4) and the primary coil and the output of the comparator (K) is taken to the control electrode of the semiconductor switch (T, T1 . . . T4).

10. Alternating current ignition system in accordance with claim 9, wherein a MOS-controlled thyristor (MCT) is used as semiconductor switch (T, T1 . . . T4).

* * * * *